US010801365B2

(12) United States Patent
Rzeszutek et al.

(10) Patent No.: US 10,801,365 B2
(45) Date of Patent: Oct. 13, 2020

(54) TURBINE ENGINE AND COMPONENTS FOR USE THEREIN

(71) Applicant: General Electric Company Polska sp. z.o.o, Warsaw (PL)

(72) Inventors: Leszek Marek Rzeszutek, Mazowieckie (PL); Dariusz Olczak, Mazowieckie (PL); Grzegorz Maciej Kaczmarek, Mazowieckie (PL); Tomasz Bulsiewicz, Mazowieckie (PL); Maciej Michal Stanczyk, Mazowieckie (PL); Adam Tralewski, Mazowieckie (PL)

(73) Assignee: General Electric Company Polska sp. z o.o., Warsaw (PL)

( * ) Notice: Subject to any disclaimer, the term of this patent is extended or adjusted under 35 U.S.C. 154(b) by 292 days.

(21) Appl. No.: 15/906,466

(22) Filed: Feb. 27, 2018

(65) Prior Publication Data

US 2019/0071994 A1 Mar. 7, 2019

(30) Foreign Application Priority Data

Apr. 4, 2017 (PL) ..... 421120

(51) Int. Cl.

| | |
|---|---|
| ***F01D 25/14*** | (2006.01) |
| ***F01D 11/00*** | (2006.01) |
| ***F01D 9/06*** | (2006.01) |
| ***F01D 25/24*** | (2006.01) |

(52) U.S. Cl.

CPC ..... *F01D 25/14* (2013.01); *F01D 9/06* (2013.01); *F01D 11/005* (2013.01); *F01D 25/246* (2013.01); *F05D 2220/3212* (2013.01); *F05D 2240/12* (2013.01); *F05D 2240/55* (2013.01); *F05D 2250/11* (2013.01); *F05D 2250/141* (2013.01); *F05D 2250/311* (2013.01); *F05D 2260/20* (2013.01)

(58) Field of Classification Search

None

See application file for complete search history.

(56) References Cited

U.S. PATENT DOCUMENTS

| | | | | |
|---|---|---|---|---|
| 5,269,135 | A | 12/1993 | Vermejan et al. | |
| 6,217,279 | B1 * | 4/2001 | Ai | F01D 11/001 415/110 |
| 6,382,906 | B1 * | 5/2002 | Brassfield | F01D 5/18 415/115 |
| 6,804,947 | B2 | 10/2004 | Docte et al. | |
| 6,890,147 | B2 | 5/2005 | Pecchioli | |

(Continued)

*Primary Examiner* — Kenneth J Hansen
*Assistant Examiner* — Jason Fountain
(74) *Attorney, Agent, or Firm* — McGarry Bair PC

(57) ABSTRACT

A turbine engine that includes an engine casing including a fluid supply plenum, a mating surface, and a nozzle supply passage and a cavity flow passage that both extend between the fluid supply plenum and the mating surface. The turbine engine further includes a turbine nozzle assembly including a mating band. The mating band includes an inlet scoop in flow communication with the nozzle supply passage. An interface is defined between the mating band and a first portion of the mating surface, and a band cavity is defined between the mating band and a second portion of the mating surface. The cavity flow passage couples the fluid supply plenum in flow communication with the band cavity.

18 Claims, 8 Drawing Sheets

(56) References Cited

U.S. PATENT DOCUMENTS

| | | | |
|---|---|---|---|
| 7,854,124 | B2 | 12/2010 | Sadil et al. |
| 7,866,141 | B2 | 1/2011 | Jacques et al. |
| 2016/0160757 | A1 | 6/2016 | Todorovic |

* cited by examiner

TURBINE ENGINE AND COMPONENTS FOR USE THEREIN

BACKGROUND

The present disclosure relates generally to cooling components of a turbine engine and, more specifically, to systems and methods of supplying cooling air to a turbine nozzle in a turbine engine.

In a gas turbine engine, air is pressurized in a compressor and mixed with fuel in a combustor and ignited such that hot combustion gas is generated. The hot combustion gas is channeled downstream from the combustor and flows through one or more turbine stages. At least some known turbine stages include a stationary turbine nozzle having a plurality of hollow vanes extending radially between outer and inner bands. The hollow vanes have airfoil configurations for guiding the combustion gas between corresponding turbine rotor blades positioned downstream therefrom.

Turbine nozzle vanes are typically cooled with cooling air bled from the compressor to counteract heating caused by contact with the hot combustion gas. At least some known turbine nozzles include an air transfer tube, also known as a spoolie, to channel the cooling air into the hollow vanes from an air supply plenum. The spoolie facilitates limiting leakage when cooling air is channeled from the air supply plenum to the hollow vanes, and also provides thermal expansion and contraction flexibility between an air supply manifold and the hollow vanes. However, space constraints in at least some known turbine engines limit the use of spoolies therein.

BRIEF DESCRIPTION

In one aspect, a turbine engine is provided. The turbine engine includes an engine casing including a fluid supply plenum, a mating surface, and a nozzle supply passage and a cavity flow passage that both extend between the fluid supply plenum and the mating surface. The turbine engine further includes a turbine nozzle assembly including a mating band. The mating band includes an inlet scoop in flow communication with the nozzle supply passage. An interface is defined between the mating band and a first portion of the mating surface, and a band cavity is defined between the mating band and a second portion of the mating surface. The cavity flow passage couples the fluid supply plenum in flow communication with the band cavity.

In another aspect, a nozzle assembly for use in a turbine engine is provided. The nozzle assembly includes a nozzle vane and a mating band coupled to said nozzle vane. The mating band includes an inlet scoop in flow communication with said nozzle vane and a first seal positioned about said inlet scoop.

In yet another aspect, an engine casing for use in a turbine engine is provided. The engine casing includes a case body including a mating surface and a plenum surface. A nozzle supply passage is defined within the case body and extending between the mating surface and the plenum surface such that flow communication is provided between a first side and a second side of the case body. A cavity flow passage is defined within the case body and extending between the mating surface and the plenum surface such that flow communication is provided between the first side and said second side.

DRAWINGS

These and other features, aspects, and advantages of the present disclosure will become better understood when the following detailed description is read with reference to the accompanying drawings in which like characters represent like parts throughout the drawings, wherein.

Figure 1:
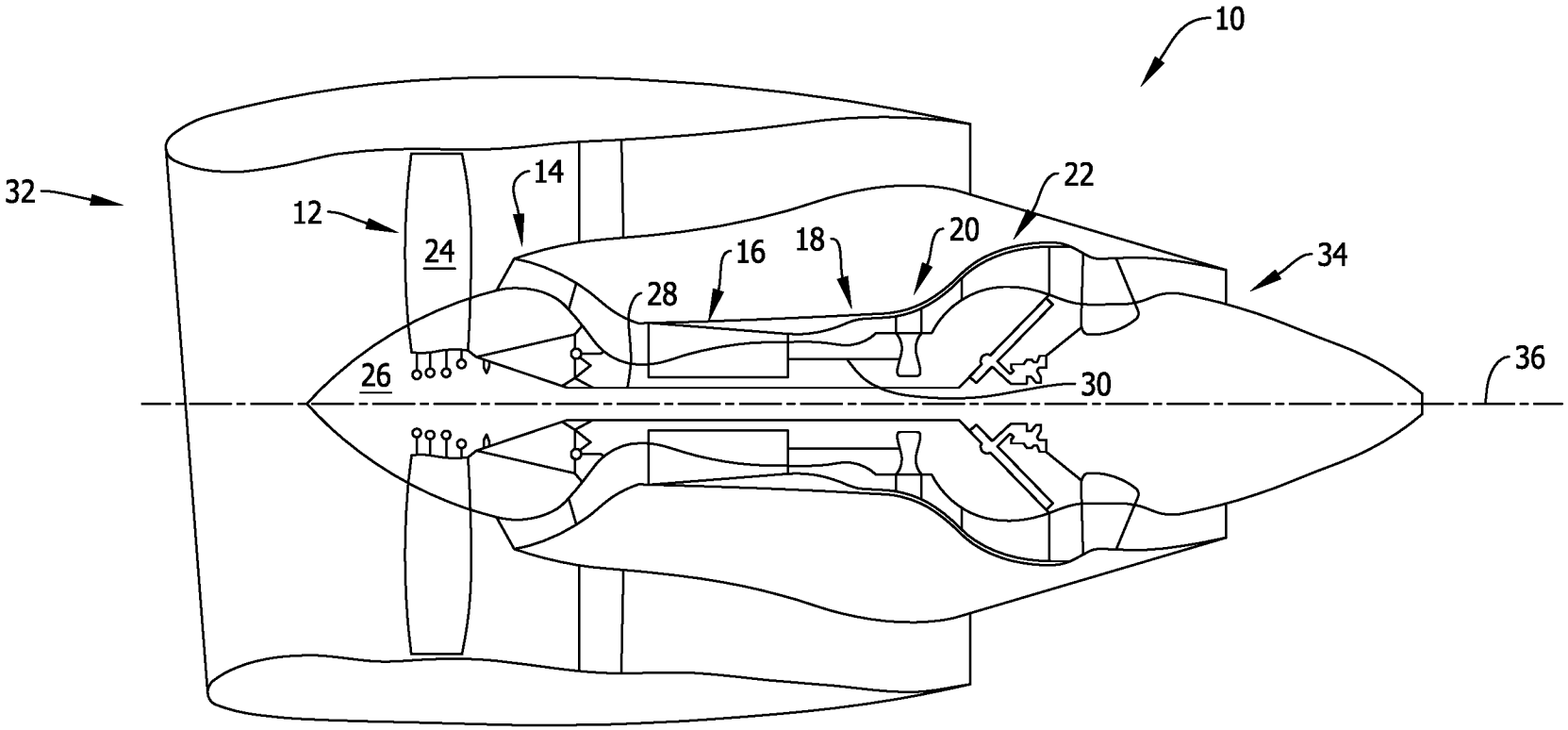
FIG. 1 is a schematic illustration of an exemplary turbine engine.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

Embodiments of the present disclosure relate to systems and methods of supplying cooling air to a turbine nozzle in a turbine engine. More specifically, the cooling air is supplied to the turbine nozzle without the use of a spoolie. The system described herein includes an engine casing having a plurality of flow passages defined therein, and a mating band of a turbine nozzle assembly that includes an inlet scoop that receives cooling air from a nozzle supply passage of the plurality of flow passages. Adjoining faces of the engine casing and the inlet scoop are spaced from each other such that a clearance gap is defined therebetween. However, leakage from the interface defined between the adjoining faces is limited by at least partially sealing the interface, and by pressurizing a band cavity in flow communication with the interface. Pressurizing the band cavity facilitates equalizing the pressure between the band cavity and a cooling circuit of the turbine nozzle. As such, the turbine architecture described herein facilitates providing cooling air to the turbine nozzle in a space-saving and efficient manner.

While the following embodiments are described in the context of a turbofan engine, it should be understood that the systems and methods described herein are also applicable to turboprop engines, turboshaft engines, turbojet engines, ground-based turbine engines, for example.

FIG. 1 is a schematic diagram of an exemplary turbine engine 10 including a fan assembly 12, a low-pressure or booster compressor assembly 14, a high-pressure compressor assembly 16, and a combustor assembly 18. Fan assembly 12, booster compressor assembly 14, high-pressure compressor assembly 16, and combustor assembly 18 are coupled in flow communication. Turbine engine 10 also includes a high-pressure turbine assembly 20 coupled in flow communication with combustor assembly 18 and a low-pressure turbine assembly 22. Fan assembly 12 includes an array of fan blades 24 extending radially outward from a rotor disk 26. Low-pressure turbine assembly 22 is coupled to fan assembly 12 and booster compressor assembly 14 through a first drive shaft 28, and high-pressure turbine assembly 20 is coupled to high-pressure compressor assembly 16 through a second drive shaft 30. Turbine engine 10 has an intake 32 and an exhaust 34. Turbine engine 10 further includes a centerline 36 about which fan assembly 12, booster compressor assembly 14, high-pressure compressor assembly 16, and turbine assemblies 20 and 22 rotate.

In operation, air entering turbine engine 10 through intake 32 is channeled through fan assembly 12 towards booster compressor assembly 14. Compressed air is discharged from booster compressor assembly 14 towards high-pressure compressor assembly 16. Highly compressed air is channeled from high-pressure compressor assembly 16 towards combustor assembly 18, mixed with fuel, and the mixture is combusted within combustor assembly 18. High temperature combustion gas generated by combustor assembly 18 is channeled towards turbine assemblies 20 and 22. Combustion gas is subsequently discharged from turbine engine 10 via exhaust 34.

Figure 2:
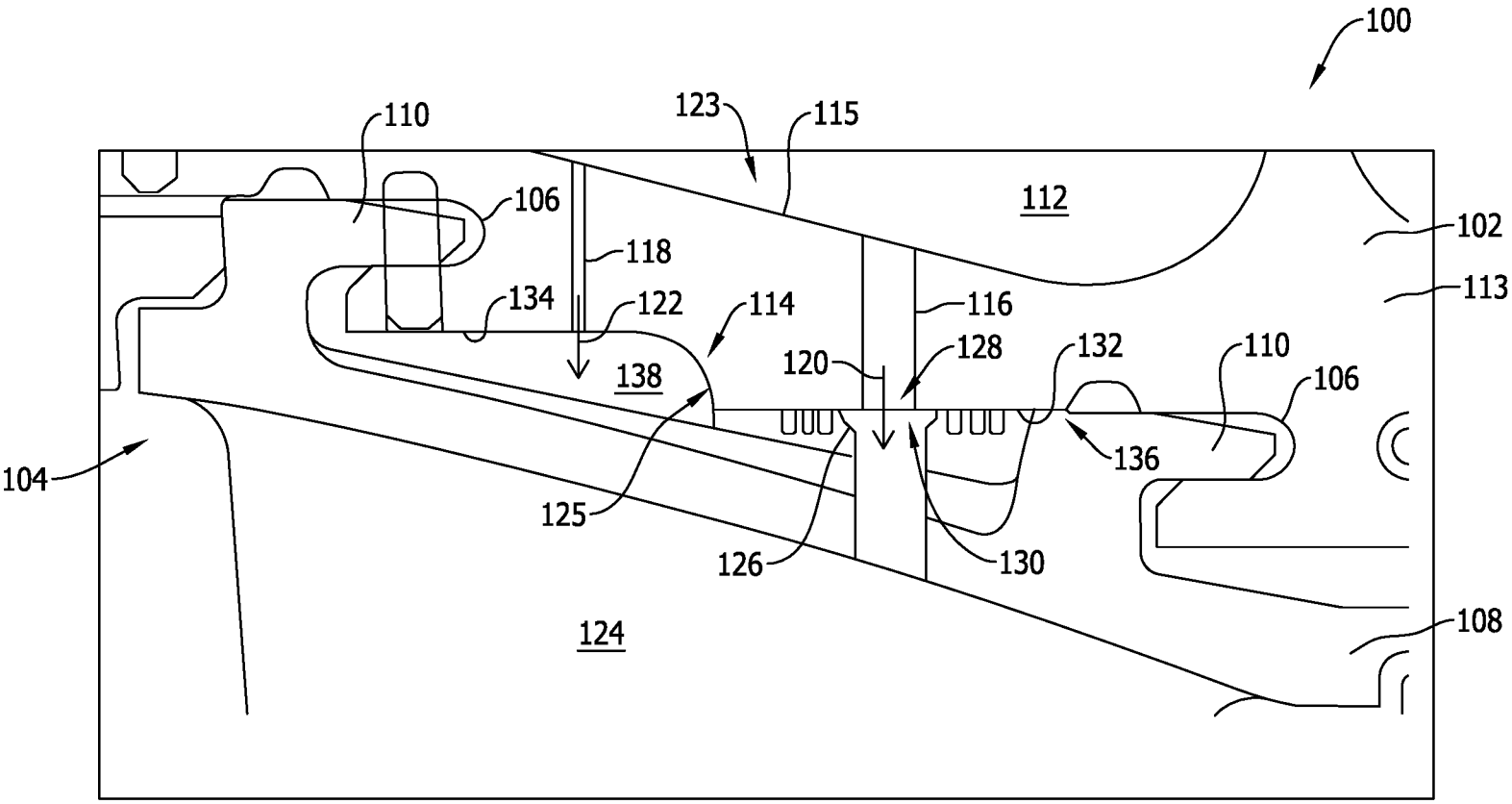
FIG. 2 is a cross-sectional illustration of an exemplary cooling fluid supply system that may be used in the turbine engine shown in FIG. 1.
Figure 3:
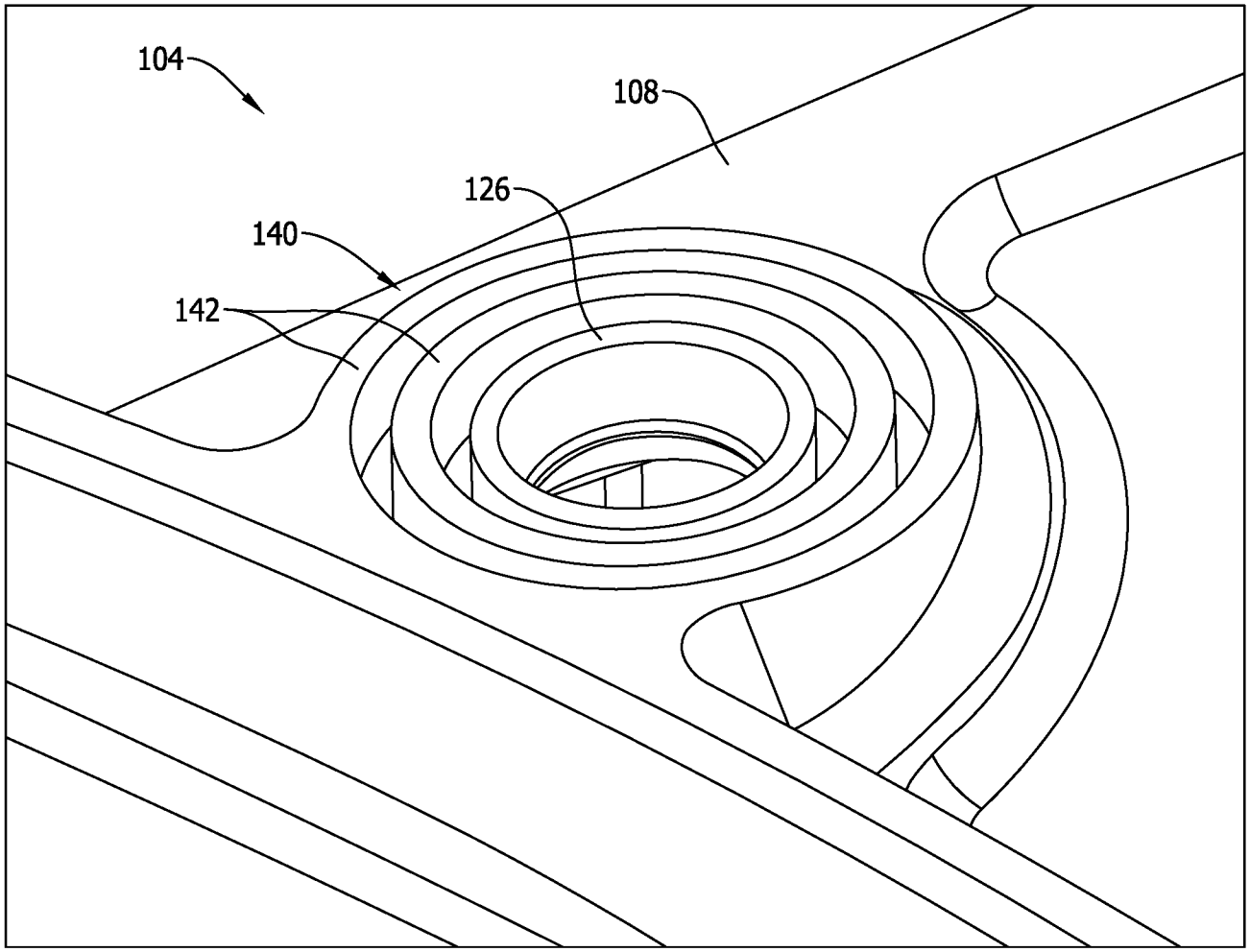
FIG. 3 is a perspective view of an exemplary turbine nozzle assembly that may be used in the cooling fluid supply system shown in FIG. 2.

FIG. 2 is a cross-sectional illustration of an exemplary cooling fluid supply system 100 that may be used in turbine engine 10 (shown in FIG. 1), and FIG. 3 is a perspective view of an exemplary turbine nozzle assembly that may be used in cooling fluid supply system 100. In the exemplary embodiment, turbine engine 10 and cooling fluid supply system 100 include an engine casing 102 and a turbine nozzle assembly 104 coupled to engine casing 102. More specifically, engine casing 102 includes at least one receiving slot 106, and turbine nozzle assembly 104 includes a mating band 108 and a nozzle vane 124. Turbine nozzle assembly 104 includes a hook member 110 extending from mating band 108 and sized for insertion within receiving slot 106. Hook member 110 is oriented to extend substantially axially relative to centerline 36 (shown in FIG. 1), and receiving slot 106 is oriented similarly to hook member 110. As such, when installing turbine nozzle assembly 104 within turbine engine 10, mating band 108 is translated axially such that hook member 110 is received within receiving slot 106.

Engine casing 102 further includes a fluid supply plenum 112, and a case body 113 including a mating surface 114 and a plenum surface 115. Fluid supply plenum 112 receives bleed air (not shown) from at least one of booster compressor assembly 14 or high-pressure compressor assembly 16 (both shown in FIG. 1). In addition, engine casing 102 includes a plurality of flow passages defined therein. For example, the plurality of flow passages includes a nozzle supply passage 116 and a cavity flow passage 118 that both extend between fluid supply plenum 112, or plenum surface 115, and mating surface 114. As such, the bleed air is channeled through nozzle supply passage 116 and cavity flow passage 118 substantially simultaneously. More specifically, nozzle supply passage 116 channels cooling fluid 120 therethrough and cavity flow passage 118 channels pressurizing fluid 122 therethrough such that flow communication is provided between a first side 123 and a second side 125 of case body 113, as will be explained in more detail below.

In the exemplary embodiment, turbine nozzle assembly 104 includes mating band 108 and a nozzle vane 124 coupled to mating band 108. Nozzle vane 124 is at least partially hollow such that cooling fluid 120 received therein facilitates cooling nozzle vane 124. Moreover, mating band 108 includes an inlet scoop 126 that receives cooling fluid 120 from nozzle supply passage 116. More specifically, nozzle supply passage 116 includes a discharge opening 128 and inlet scoop 126 includes an intake opening 130 substantially aligned with discharge opening 128. As described above, cooling fluid 120 is channeled from nozzle supply passage 116 into inlet scoop 126 without the use of an intermediate flow conduit, such as a spoolie (not shown). As such, in one embodiment, intake opening 130 is sized greater than discharge opening 128 such that inlet scoop 126 receives substantially all cooling fluid 120 discharged from nozzle supply passage 116.

As described above, inlet scoop 126 receives cooling fluid 120 from nozzle supply passage 116. In the exemplary embodiment, mating surface 114 includes a first portion 132 and a second portion 134. When turbine nozzle assembly 104 is installed with engine casing 102, an interface 136 is defined between mating band 108 and first portion 132 of mating surface 114, and a band cavity 138 is defined between mating band 108 and second portion 134 of mating surface 114. More specifically, band cavity 138 is restricted by contact surfaces of hook members 110. As described above, nozzle supply passage 116 channels cooling fluid 120 therethrough and cavity flow passage 118 channels pressurizing fluid 122 therethrough. Cavity flow passage 118 is positioned to provide pressurizing fluid 122 to band cavity 138. Pressurizing fluid 122 pressurizes band cavity 138 such that a back pressure between band cavity 138 and a main gas path (i.e., a hot gas path) extending through turbine engine 10 is provided, thereby restricting the ingestion of hot gas through mating band 108. In addition, nozzle supply passage 116 is sized such that static pressure therein is substantially equal to static pressure in band cavity 138.

Nozzle supply passage 116 and cavity flow passage 118 are sized such that a static pressure of cooling fluid 120 channeled through nozzle supply passage 116 is substantially equal to a static pressure of pressurizing fluid 122 within band cavity 138. As such, a pressure across interface 136 is substantially equalized, which facilitates restricting leakage of cooling fluid 120 therefrom.

In the exemplary embodiment, at least one seal is formed on at least one of engine casing 102 or mating band 108. More specifically, referring to FIG. 3, mating band 108 includes a first seal 140 positioned about inlet scoop 126 such that leakage is restricted at interface 136 when cooling fluid 120 is channeled from nozzle supply passage 116 (all shown in FIG. 2) to inlet scoop 126. First seal 140 includes a plurality of seal members 142 spaced concentrically from each other about inlet scoop 126 (i.e., a labyrinth seal). As such, first seal 140 limits leakage from interface 136 in the event that a pressure drop is formed across interface 136, such as from depressurization of band cavity 138. Alternatively, first seal 140 is formed on first portion 132 of mating surface 114 (both shown in FIG. 2) and seal members 142 extend towards mating band 108. Moreover, alternatively, a seal is not formed on either engine casing 102 or mating band 108.

Figure 4:
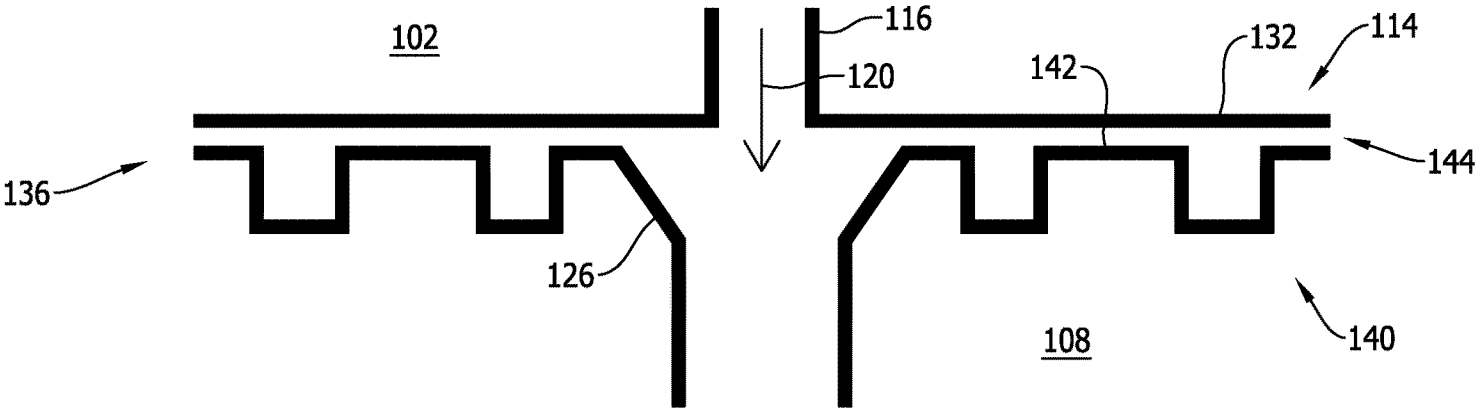
FIG. 4 is an enlarged cross-sectional illustration of an exemplary engine casing-mating band interface that may be in the cooling fluid supply system shown in FIG. 2.
Figure 5:
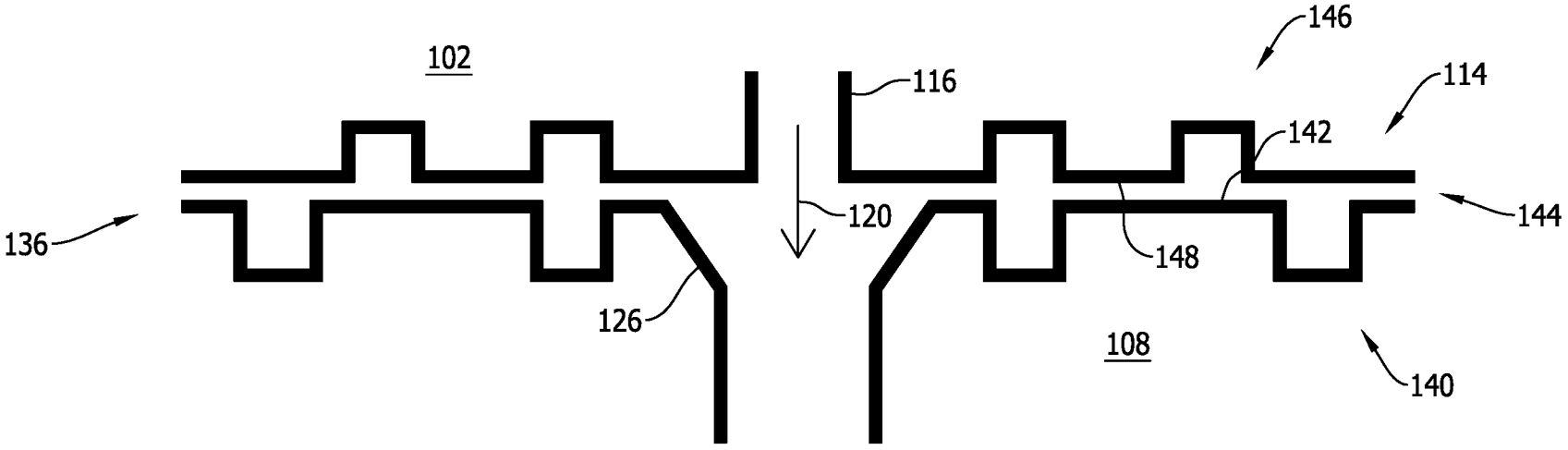
FIG. 5 is an enlarged cross-sectional illustration of an alternative engine casing-mating band interface that may be in the cooling fluid supply system shown in FIG. 2.
Figure 6:
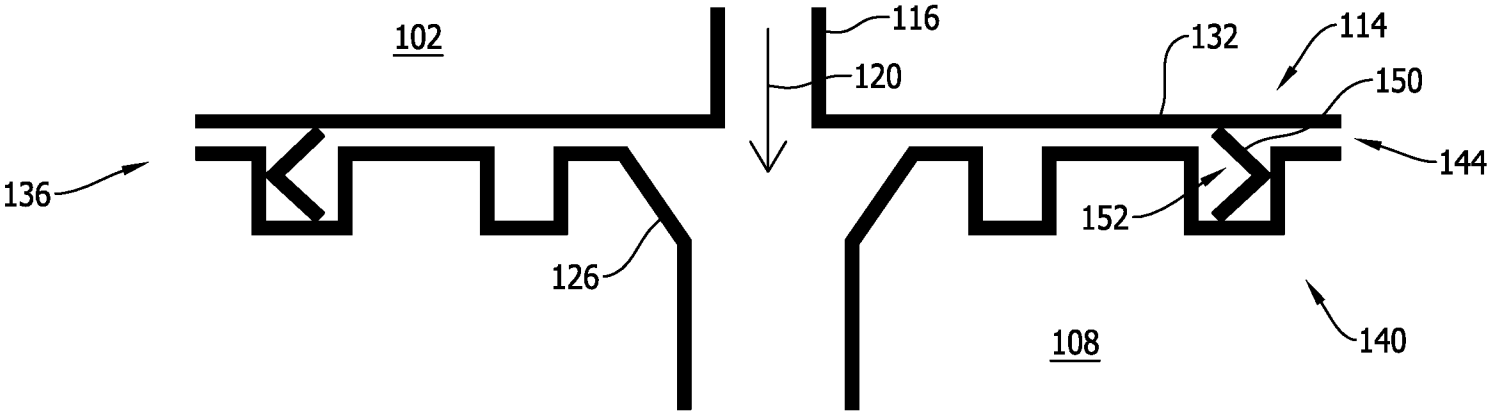
FIG. 6 is an enlarged cross-sectional illustration of a further alternative engine casing-mating band interface that may be in the cooling fluid supply system shown in FIG. 2.

FIGS. 4-6 are enlarged cross-sectional illustrations of an engine casing-mating band interface 136 that may be in cooling fluid supply system 100. As described above, cooling fluid 120 sometimes leaks from interface 136 when a pressure drop is formed across interface 136. More specifically, referring to FIG. 4, mating band 108 and first portion 132 of mating surface 114 are spaced from each other such that a clearance gap 144 is defined at interface 136. Clearance gap 144 provides flow communication between nozzle supply passage 116 and band cavity 138 (shown in FIG. 2). Moreover, while shown as including clearance gap 144, it should be understood that interface 136 is sometimes defined by non-sealing contact between mating band 108 and mating surface 114.

Referring to FIG. 5, cooling fluid supply system 100 further includes a second seal 146 formed on engine casing 102. Second seal 146 includes a plurality of seal members 148 spaced concentrically from each other about discharge opening 128 of nozzle supply passage 116 (i.e., a labyrinth seal). In addition, seal members 148 are either at least partially offset or overlap with seal members 142 such that sealing of interface 136 is enhanced. Moreover, seal members 148 are oriented to facilitate axial translation of engine casing 102 relative to mating band 108.

Referring to FIG. 6, cooling fluid supply system 100 further includes a third seal 150 positioned within a groove 152 defined between adjacent seal members 142. More specifically, third seal 150 is an annular seal member that extends within groove 152. Exemplary annular seal members include, but are not limited to, a braided rope seal, a V-seal member, a Z-seal member, a W-seal member, and a labyrinth seal insert. Positioning third seal 150 within groove 152 facilitates enhancing sealing of interface 136, which facilitates increasing a pressure drop formed across interface 136.

Figure 7:
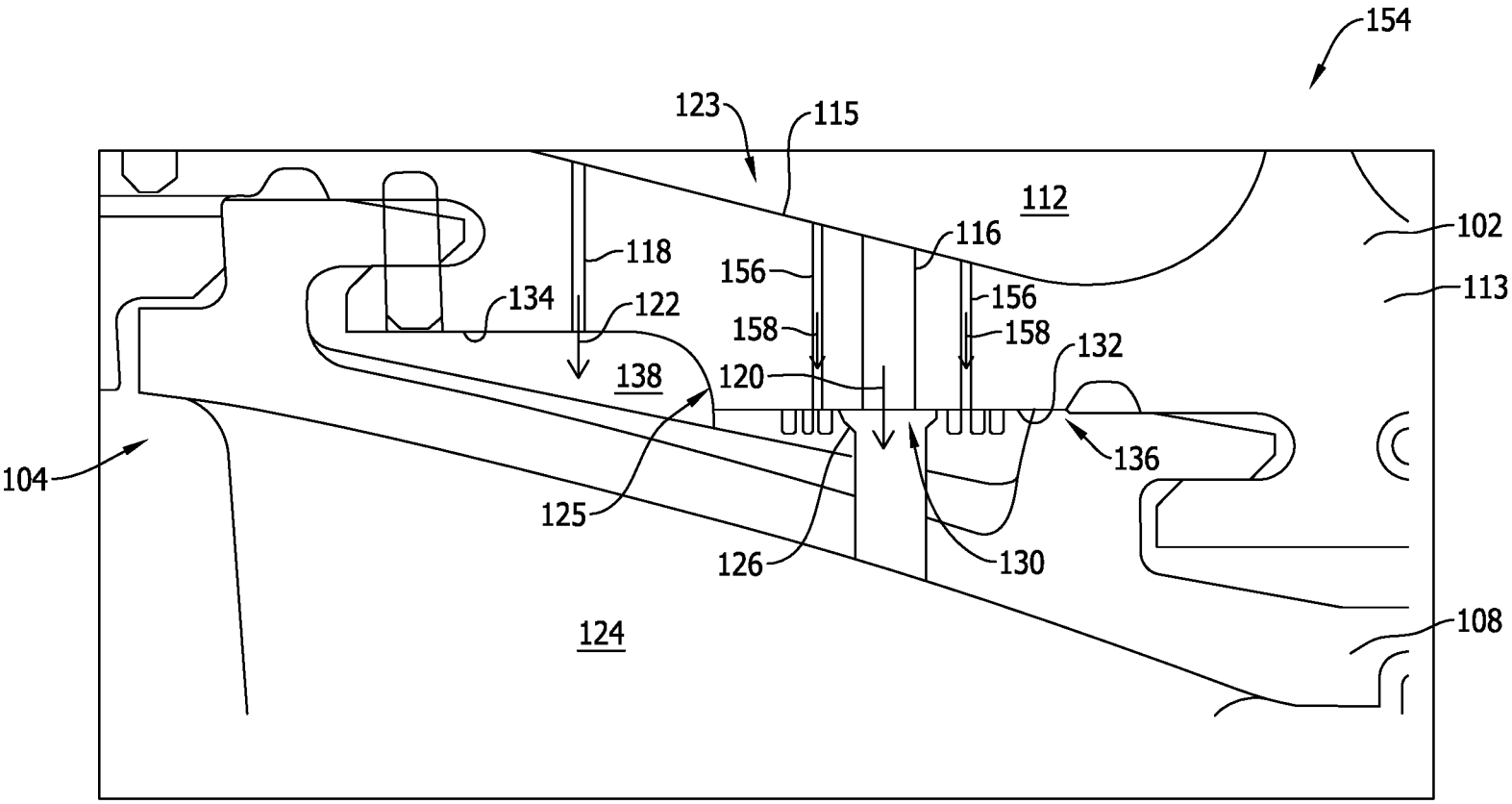
FIG. 7 is a cross-sectional illustration of an alternative cooling fluid supply system that may be used in the turbine engine shown in FIG. 1.
Figure 8:
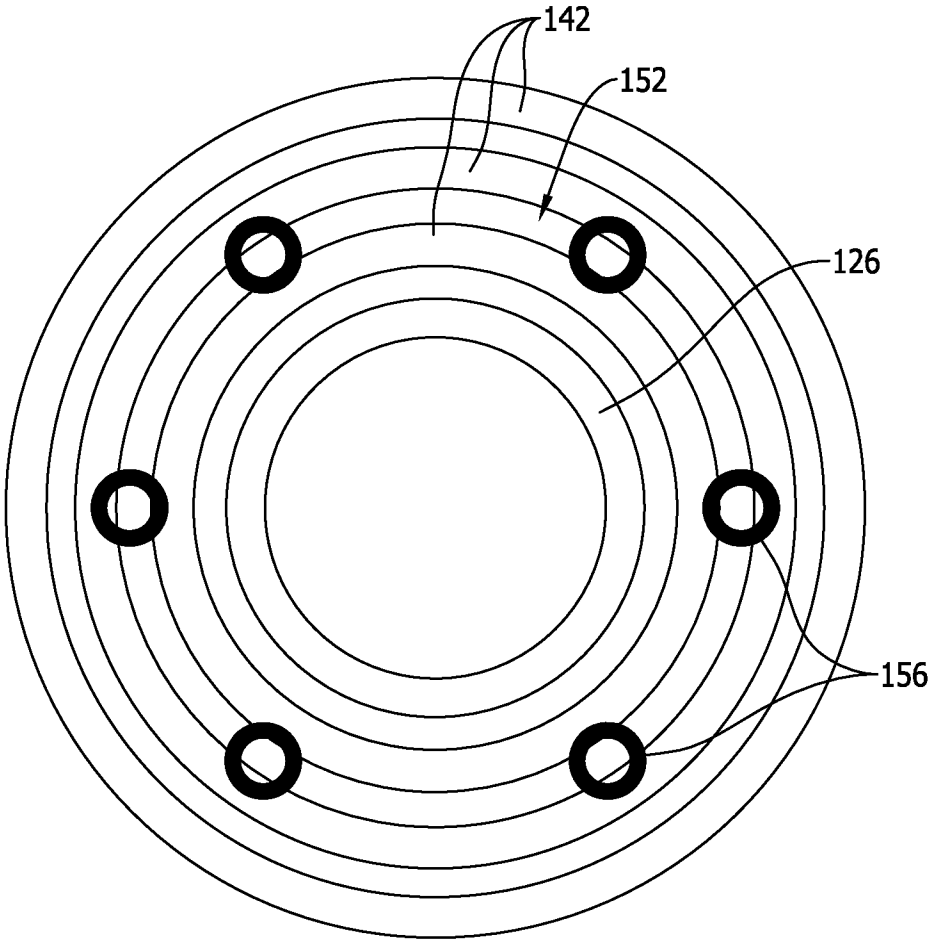
FIG. 8 is a radial view of an exemplary engine casing-mating band interface that may be in the cooling fluid supply system shown in FIG. 7.

FIG. 7 is a cross-sectional illustration of an alternative cooling fluid supply system 154 that may be used in turbine engine 10 (shown in FIG. 1), and FIG. 8 is a radial view of an exemplary engine casing-mating band interface that may be in cooling fluid supply system 154. As described above, engine casing 102 includes a plurality of flow passages defined therein, such as nozzle supply passage 116 and cavity flow passage 118. In the exemplary embodiment, engine casing 102 further includes at least one sealing flow passage 156 extending between fluid supply plenum 112 and mating surface 114. Sealing flow passage 156 provides sealing fluid 158 to interface 136 such that a sealing fluid barrier (not shown) is formed about inlet scoop 126. In an alternative embodiment, one or more of cooling fluid 120, pressurizing fluid 122, and sealing fluid 158 are provided from a source other than fluid supply plenum 112.

For example, referring to FIG. 8, a plurality of sealing flow passages 156 are positioned about inlet scoop 126. In one embodiment, sealing flow passages 156 discharge sealing fluid 158 (shown in FIG. 7) within groove 152 defined between adjacent seal members 142. As such, sealing fluid 158 fills groove 152, thereby forming the sealing fluid barrier and enhancing sealing of interface 136.

An exemplary technical effect of the systems and methods described herein includes at least one of: (a) providing cooling air to a cooling circuit of a turbine nozzle assembly; (b) eliminating the use of an air transfer tube, or spoolie, from the turbine engine; and (c) facilitating assembly of the turbine engine in a simplified and efficient manner.

Exemplary embodiments of a cooling fluid delivery system for use with a turbine engine and related components are described above in detail. The system is not limited to the specific embodiments described herein, but rather, components of systems and/or steps of the methods may be utilized independently and separately from other components and/or steps described herein. For example, the configuration of components described herein may also be used in combination with other processes, and is not limited to practice with only providing compressor bleed air to a stator vane of a turbine engine. Rather, the exemplary embodiment can be implemented and utilized in connection with many applications where providing cooling fluid or heating fluid, as in an anti-icing system, is desired.

Although specific features of various embodiments of the present disclosure may be shown in some drawings and not in others, this is for convenience only. In accordance with the principles of embodiments of the present disclosure, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine engine comprising:

an engine casing including a fluid supply plenum, a mating surface, and a nozzle supply passage and a cavity flow passage that both extend between the fluid supply plenum and the mating surface;

a turbine nozzle assembly including a mating band that includes an inlet scoop in flow communication with the nozzle supply passage, wherein an interface is defined between the mating band and a first portion of the mating surface, and a band cavity is defined between the mating band and a second portion of the mating surface, wherein the cavity flow passage couples the fluid supply plenum in flow communication with the band cavity;

an intake opening of the inlet scoop; and a discharge opening of the nozzle supply passage where the intake opening is sized greater than the discharge opening.

2. The turbine engine of claim 1, wherein the mating band and the first portion of the mating surface are spaced from each other such that the nozzle supply passage is in flow communication with the band cavity.

3. The turbine engine of claim 1 further comprising a first seal formed on at least one of the engine casing or the mating band, the first seal positioned about the inlet scoop.

4. The turbine engine of claim 3, wherein the first seal is formed on the mating band, the turbine engine further comprising a second seal formed on the engine casing.

5. The turbine engine of claim 3, wherein the first seal comprises a plurality of seal members spaced concentrically from each other about the inlet scoop.

6. The turbine engine of claim 5 further comprising a third seal positioned within a groove defined between adjacent seal members of the plurality of seal members.

7. The turbine engine of claim 5, wherein the engine casing further comprises at least one sealing flow passage extending between the fluid supply plenum and the mating surface such that the fluid supply plenum is in flow communication with the first seal.

8. The turbine engine of claim 7, wherein the at least one sealing flow passage is configured to discharge sealing fluid within a groove defined between adjacent seal members of the plurality of seal members.

9. A nozzle assembly for use in a turbine engine, the nozzle assembly comprising:

a nozzle vane; and a mating band coupled to the nozzle vane, wherein the mating band includes:

an inlet scoop coupled in flow communication with the nozzle vane;

a first seal positioned about the inlet scoop, wherein the first seal comprises a plurality of seal members spaced concentrically from each other about the inlet scoop; and a third seal positioned within a groove defined between adjacent seal members of the plurality of seal members.

10. The nozzle assembly of claim 9, wherein the third seal comprises at least one of a braided rope seal, a V-seal member, a Z-seal member, a W-seal member, and a labyrinth seal insert.

11. The nozzle assembly of claim 9 further comprising a hook member extending from the mating band, wherein the hook member is oriented to extend substantially axially relative to a centerline of the turbine engine.

12. An engine casing for use in a turbine engine, the engine casing comprising:

a case body including a mating surface and a plenum surface;

a nozzle supply passage defined within the case body and extending between the mating surface and the plenum surface such that flow communication is provided between a first side and a second side of the case body;

a cavity flow passage defined within the case body and extending between the mating surface and the plenum surface such that flow communication is provided between the first side and the second side; and a first seal formed on the mating surface of the case body, wherein the first seal positioned about a discharge opening of the nozzle supply passage, wherein the first seal comprises a plurality of seal members spaced concentrically from each other about the discharge opening of the nozzle supply passage.

13. The engine casing of claim 12 further comprising at least one sealing flow passage defined within the case body and extending between the mating surface and the plenum surface such that flow communication is provided between the first side and the second side.

14. The engine casing of claim 13, wherein the at least one sealing flow passage comprises a plurality of sealing flow passages arranged circumferentially about the nozzle supply passage.

15. The engine casing of claim 12 further comprising a receiving slot defined within the case body.

16. A turbine engine comprising:

an engine casing including a fluid supply plenum, a mating surface, a nozzle supply passage with a discharge opening, and a cavity flow passage, wherein the nozzle supply passage and the cavity flow passage extend between the fluid supply plenum and the mating surface;

a band cavity defined in part by the mating surface, wherein the cavity flow passage fluidly couples the fluid supply plenum in flow communication with the band cavity; and a turbine nozzle assembly that includes an inlet scoop with an intake opening in flow communication with the nozzle supply passage, wherein the intake opening is sized greater than the discharge opening.

17. The turbine engine of claim 16 further comprising a first seal formed on the mating surface, wherein the first seal positioned about the discharge opening of the nozzle supply passage.

18. The turbine engine of claim 17, wherein the first seal comprises a plurality of seal members spaced concentrically from each other about the discharge opening of the nozzle supply passage.

* * * * *